US007331352B2

(12) United States Patent
Ramet

(10) Patent No.: US 7,331,352 B2
(45) Date of Patent: Feb. 19, 2008

(54) DEVICE FOR APPLYING A PRODUCT TO HAIR

(75) Inventor: Marc Ramet, Asnieres (FR)

(73) Assignee: L'Oreal, Paris (FR)

( * ) Notice: Subject to any disclaimer, the term of this patent is extended or adjusted under 35 U.S.C. 154(b) by 415 days.

(21) Appl. No.: 10/929,463

(22) Filed: Aug. 31, 2004

(65) Prior Publication Data

US 2005/0081871 A1 Apr. 21, 2005

Related U.S. Application Data

(60) Provisional application No. 60/511,104, filed on Oct. 15, 2003.

(30) Foreign Application Priority Data

Sep. 5, 2003 (FR) ..... 03 10523

(51) Int. Cl.
*A45D 24/22* (2006.01)

(52) U.S. Cl. ..... 132/116

(58) Field of Classification Search ..... 132/112–116; 119/602–605; D28/25, 28; 401/183, 184, 401/185

See application file for complete search history.

(56) References Cited

U.S. PATENT DOCUMENTS

| | | | | | |
|---|---|---|---|---|---|
| 1,757,290 | A | | 5/1930 | Bricker | |
| 2,454,642 | A | * | 11/1948 | Finman | 132/141 |
| 2,513,865 | A | * | 7/1950 | Hazza et al. | 132/113 |
| 2,624,348 | A | * | 1/1953 | Matson | 132/114 |
| 2,930,385 | A | * | 3/1960 | Fees | 132/214 |
| 3,424,176 | A | * | 1/1969 | Hale | 132/112 |
| 4,213,423 | A | * | 7/1980 | Bryan et al. | 119/605 |
| 4,516,591 | A | | 5/1985 | Hierholzer | |
| 4,605,026 | A | * | 8/1986 | Nolin | 132/112 |
| 4,799,456 | A | * | 1/1989 | Young | 119/603 |
| 4,961,439 | A | | 10/1990 | Hartmann | |
| 4,993,438 | A | | 2/1991 | Hunt | |
| 4,996,438 | A | | 2/1991 | Nagata et al. | |
| 5,152,306 | A | | 10/1992 | Stephan | |
| 5,337,765 | A | | 8/1994 | Wong | |

(Continued)

FOREIGN PATENT DOCUMENTS

| | | |
|---|---|---|
| FR | 2475374 | 8/1981 |

(Continued)

OTHER PUBLICATIONS

Patent Abstracts of Japan, JP 2002-345543, Dec. 3, 2002.

*Primary Examiner*—Todd E. Manahan
(74) *Attorney, Agent, or Firm*—Oblon, Spivak, McClelland, Maier & Neustadt, P.C.

(57) ABSTRACT

A device for applying a fluid product to hair. The device includes a product reservoir, and a comb having at least two groups of teeth. The two groups of teeth each include at least two teeth, and the distance between the two groups of teeth is greater than the distance between at least two adjacent teeth in each group of teeth. In addition each group of teeth is supplied with product from at least one product exit opening communicating with the interior of the reservoir. The space between the two groups of teeth is substantially free of teeth or has projections whose average length is smaller than the average length of the teeth in the groups of teeth.

63 Claims, 3 Drawing Sheets

U.S. PATENT DOCUMENTS

| | | | | |
|---|---|---|---|---|
| 5,558,104 | A * | 9/1996 | Clouser | 132/144 |
| 5,694,953 | A | 12/1997 | Stephan et al. | |
| 5,845,651 | A | 12/1998 | de Nervo | |
| 6,286,518 | B1 * | 9/2001 | Laporte | 132/116 |
| 6,332,726 | B2 * | 12/2001 | Yamamoto et al. | 401/183 |
| 6,378,529 | B1 | 4/2002 | Clemente Marco | |
| D468,863 | S * | 1/2003 | Irving | D28/21 |
| 6,976,495 | B2 * | 12/2005 | Vena et al. | 132/112 |
| 2004/0011370 | A1 | 1/2004 | Vena et al. | |

FOREIGN PATENT DOCUMENTS

| | | |
|---|---|---|
| JP | JU-A S60-168404 | 11/1985 |
| JP | JU-A H2-86404 | 7/1990 |
| JP | 2001-186918 | 7/2001 |
| JP | 2002-519081 | 7/2002 |

* cited by examiner

DEVICE FOR APPLYING A PRODUCT TO HAIR

CROSS REFERENCE TO RELATED APPLICATIONS

This document claims priority to French Application Number 03 10523, filed Sep. 5, 2003 and U.S. Provisional Application No. 60/511,104, filed Oct. 15, 2003, the entire contents of which are hereby incorporated by reference.

BACKGROUND OF THE INVENTION

1. Field of the Invention

The present invention relates to a device for applying a product. The invention is particularly advantageous for applying a dyeing or lightening product to strands of hair.

2. Discussion of Background

When applying products to strands of hair, it is typical to first isolate strands of hair before applying a product to them. Various methods are currently used to isolate strands of hair.

In a first method, a perforated cap is placed on the customer's head. An implement having a hook at one end is used to pull strands of hair underneath the perforations out through the cap. The product is then applied uniformly to these strands using a brush. After an appropriate contact time has elapsed, the cap is removed. The action of the dye product is then neutralized with a shampoo. A method of this kind is described for example in U.S. Pat. No. 4,961,439. This method has many disadvantages. In particular, the method is painful for the customer when the strands are pulled out through the cap and when the cap is removed. In addition, the method takes a long time and is tedious to carry out.

In another method, the strand is placed on a paddle. The product is applied to the strand with a brush. The strands of hair are left exposed to the air and are separated from the rest of the hair with cotton wadding placed at the hair roots. After the appropriate contact time, the hair is washed in the conventional manner. This method is also disadvantageous in that it takes a long time and is tedious.

It is also known to use combs that enable strands to be separated from the rest of the hair. For example, U.S. Pat. Nos. 4,993,438, 5,152,306 and 5,694,953 describe combs that enable strands of hair to be isolated. However, all these devices require the isolated strands to be held in one hand and the product to be applied with the other hand, which is not very convenient.

U.S. Pat. No. 4,516,591 describes a comb for applying a product which includes a row of teeth arranged in pairs with the same uniform spacing along the entire row.

There is a need to make it easier to create dyed or lightened strands of hair. Preferably, the hair treatment should be easily performed by one person.

There is also a need to be able to dye or lighten strands of hair in a reproducible manner over the entire head.

Furthermore there is a need to be able to dye or lighten strands of hair relatively quickly.

SUMMARY OF THE INVENTION

In accordance with one of the objects of the invention, an advantageous device for applying a fluid product to hair is provided. In accordance with a preferred example, the device includes a product reservoir and a comb. The comb includes at least two groups of teeth, each including at least two teeth, with the distance between the two groups of teeth being greater than the distance between at least two adjacent teeth in each group of teeth. Each group of teeth is supplied with product from at least one product exit opening communicating with the interior of the reservoir. In addition, the space between two groups of teeth is substantially free of teeth or has projections whose average length is smaller than the average length of the teeth in the groups of teeth. In particular, where projections are provided, when a line is drawn along the free ends of each of the teeth, the free ends of the projections are recessed behind this line.

In the preferred arrangement, only the groups of teeth can be supplied with product. If projections are provided between the groups, they preferably serve only to comb the hair.

Treatment, such as dyeing, of the strands is easier because the product is applied to strands of hair in a single movement.

In accordance with another advantageous feature, the invention can provide a device for applying a product to strands of hair which is relatively inexpensive to manufacture and which can be sold with a container containing a measured quantity of product for one application. In addition, the device can also be supplied together with several containers as refills.

In accordance with a preferred example, since the groups of teeth are adequately spaced apart, the user can readily identify the parts of the comb that enable the product to be applied and he or she is thus able to position the comb easily on his or her hair in order to dye or bleach the desired strands of hair.

By way of example, the distance between the two groups of teeth can be greater than the distance between two end teeth in a group.

The product exit opening can be located between two teeth in the same group, preferably at the base of a tooth. Alternatively, the teeth can be hollow and the opening can be formed at the tip of the tooth or between the base and the tip of the tooth. Preferably, a product exit opening is provided between each tooth in the same group.

As a further alternative, the teeth have ends which can lie substantially on an outwardly concave line, preferably with a curvature substantially conforming to that of the head.

The comb can be removably fastened to the container, for example, with the comb screwed on to the container. The same comb can thus be reused with a fresh bottle used as a refill.

By way of example, the container can have a longitudinal axis X parallel to a plane containing the teeth and can form a means by which the comb can be gripped.

According to another alternative feature, the container can have resiliently deformable walls. This makes product application easier, because the user only need press the walls of the bottle, with greater or lesser force as desired, in order to dispense the product.

The container can contain a cosmetic product. The product can be a hair product, in particular a dyeing or bleaching product.

BRIEF DESCRIPTION OF THE DRAWINGS

The invention will become further apparent from the following detailed description, particularly when considered in conjunction with the drawings in which.

DETAILED DESCRIPTION OF THE PREFERRED EMBODIMENTS

Figure 1:
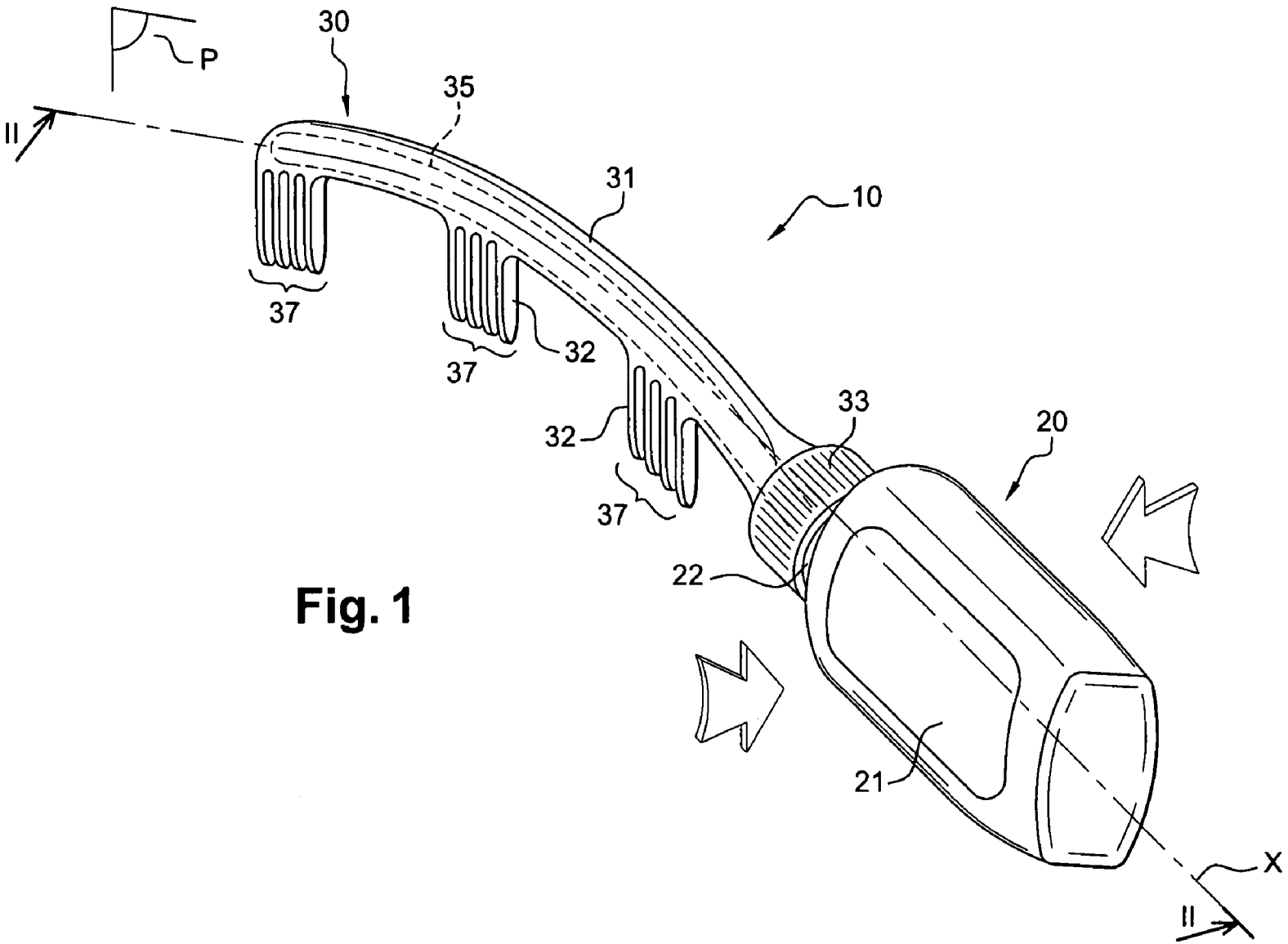
FIG. 1 is a perspective view of an applicator device in accordance with the invention
Figure 2:
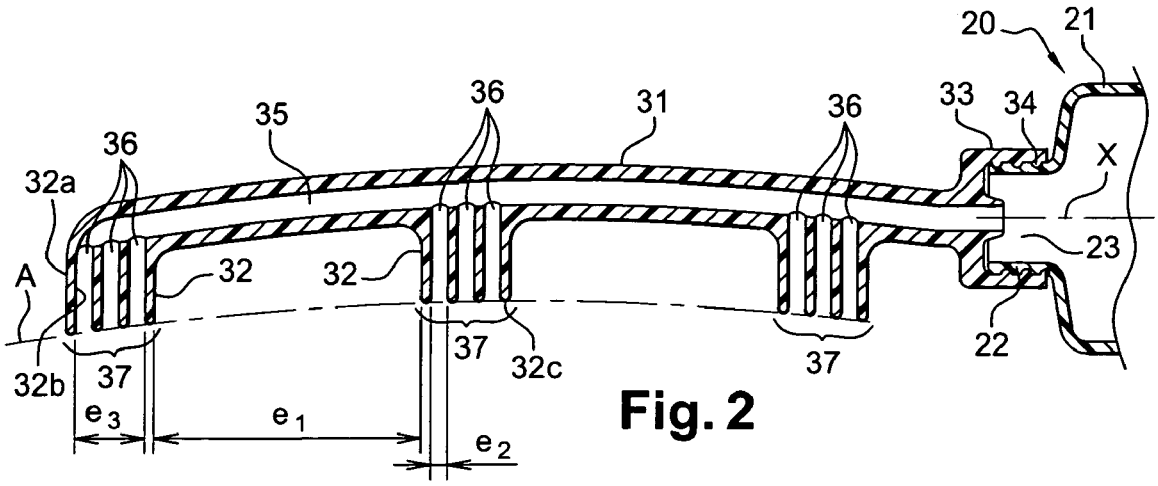
FIG. 2 is a view on section II-II of the applicator device shown in FIG. 1.
Figure 3:
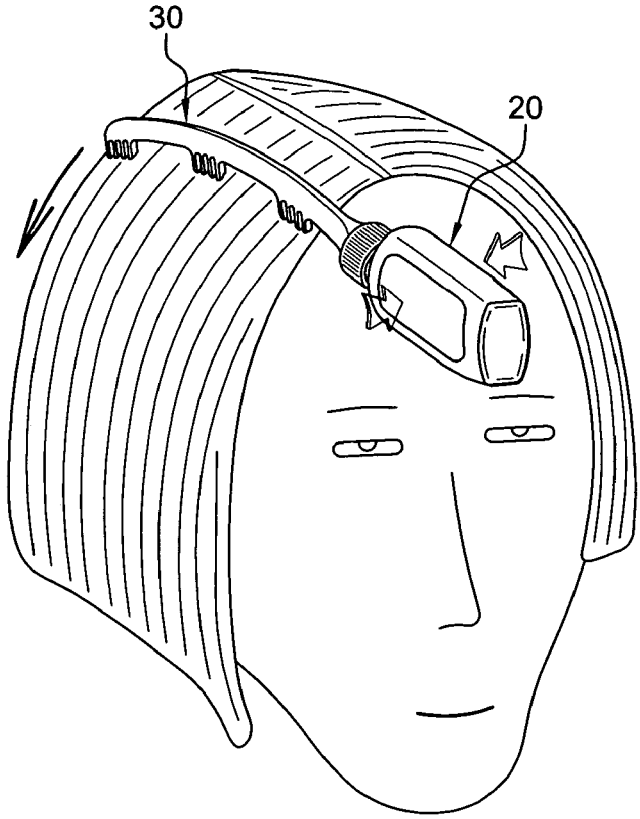
FIG. 3 shows the applicator device of FIG. 1 in use.

The device shown in FIGS. 1 to 3 is used to apply a hair product to strands of hair. The arrangement is particularly advantageous for applying a hair treatment product such as a dyeing or lightening (or bleaching) product. The device 10 includes a product reservoir 20 to which there is fastened a comb 30.

By way of example, in the illustrated embodiment, the product reservoir 20 is in the form of a bottle having a longitudinal axis X. The bottle 20 in the illustrated example has a body 21 with flexible walls which is surmounted by a neck 22 which delimits an opening 23. The neck 22 is threaded on its external surface so as to cooperate with a corresponding thread on the comb, to enable the comb to be fastened to the bottle. Other fastening expedients could also be used.

The bottle 20 contains a product that is to be applied. It also can advantageously serve as a handle for the comb in the preferred example. It therefore preferably has an ergonomic shape, enabling it to be easily held in one hand.

The comb 30 has a support 31 of a generally elongate shape, with a slight curvature in a plane P. The comb has a row of teeth 32 which extend from the concave side of the support 31 and lie in the plane P. In an alternative embodiment that is not shown, the comb can have two or more rows of teeth. For example, these various rows can be provided in planes parallel to plane P.

The support 31 has a first end intended to be fastened to the bottle by means of a ring 33 in the preferred example, and a distal end opposite the first end. The ring 33 is provided with a thread 34 on its inside surface so as to cooperate with the threaded neck of the bottle so as to fasten the comb to the bottle.

Figure 4:
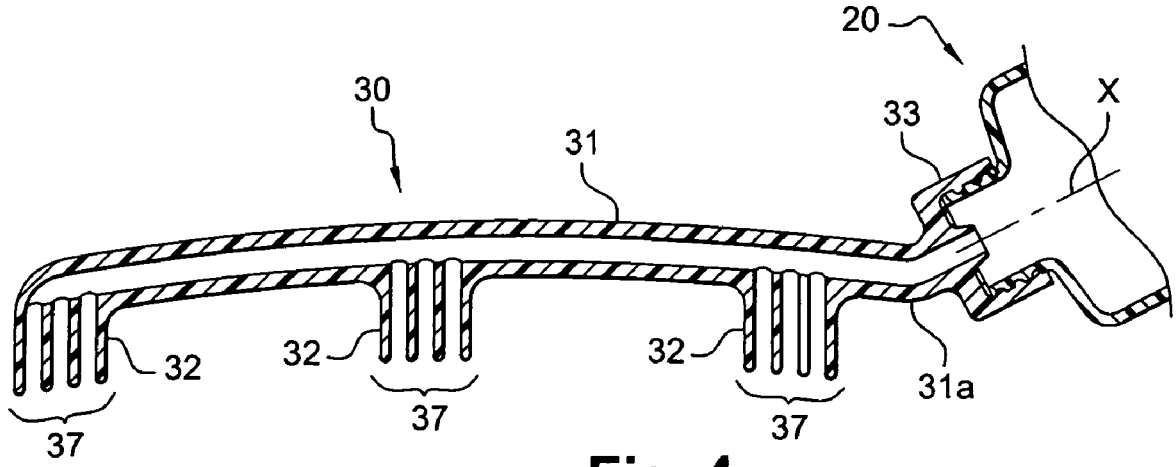
FIGS. 4 and 5 show variant forms of the applicator device in accordance with the invention.

To make the device more ergonomic, the support 31 can have a bend 31*a* between the ring 33 and the portion of the support from which the teeth extend, as shown in FIG. 4.

The support 31 is traversed by a channel 35 which opens first in the area of the fastening ring 33 in order to communicate with the interior of the bottle, and secondly in the vicinity of the teeth 32 through openings 36 in order to supply the teeth with the product.

As also shown in the embodiments illustrated in the drawings, the container or bottle 20 is spaced off to the side of the comb portion, thus allowing the comb to be easily handled and directed for use. More particularly, as shown, the bottle is spaced from the groups of teeth in the same direction as the direction which the space or distance between the groups of teeth extends. The support 31 extends substantially in the longitudinal direction of the bottle, with the flow exiting the container in substantially the same direction as the flow along the channel 35. Although the FIG. 4 arrangement includes a bend 31*a*, as can be seen, the bottle or container is spaced to the side of the comb with respect to the direction of the spacing distance between the groups of teeth as in the FIG. 2 arrangement. Also, the direction of the extension of the support is more close to parallel than perpendicular with respect to the longitudinal axis of the container and thus the support and the longitudinal axis of the container extend in substantially the same direction as shown in the drawings and as used herein.

In the example shown, the row of teeth is formed by three groups 37 of four teeth 32 arranged along the support 31. The product exit openings 36 are positioned between two consecutive teeth 32 in the same group 37, near the base of each tooth in the illustrated example. Alternate positions or numbers of openings could be used. For example, as an alternative, each group 37 can be provided with a single opening 36. The opening 36 will then be positioned for example between the two central teeth of the group. In addition, or alternatively, one or more exit openings can be provided so that the product exits the tip and/or at a location between the base and tip of the teeth. Either where the product exits from between two teeth of a group or from one or more teeth, the product exit is within the group. Preferably, one or more exit openings are provided between adjacent teeth in a group.

In this example, each of the teeth 32 of each group 37 has a substantially rectilinear longitudinal axis. When viewed in the plane P containing the row of teeth, the teeth 32 have opposite sides 32*a* and 32*b* that are substantially parallel or slightly convergent in the direction of the free end 32*c* of the corresponding teeth.

Because all the teeth 32 are of substantially the same length, their free ends 32*c* lie substantially along a line A which is parallel to the support 31, with this line being outwardly concave with a curvature conforming to that of the head.

In the example shown in the drawings, two groups 37 of teeth are separated by a first space e1 measured between two adjacent, that is to say consecutive, teeth 32 belonging respectively to two adjacent groups 37. There are no projections in the space e1. In addition, no exit opening is provided in this space, that is to say, between the two groups of teeth.

Within one group 37, two adjacent teeth 32 are separated by a second space e2.

The distance e1 between two groups 37 of teeth is greater than the distance e2 between two adjacent teeth in the same group, and preferably it is greater than the distance e3 between two end teeth in the same group 37 (the teeth at each end of the same group).

The distance e1 between two groups 37 of teeth can be varied depending on the width that is required or desired between two strands, and possibly on the nature of the hair.

Because the groups 37 of teeth are adequately spaced apart, the user can readily identify the parts of the comb that enable the product to be applied and can thus easily position the comb on his or her hair in order to dye or bleach the desired strands.

The device 10 can be used in the following manner with a product, for example for lightening or dyeing the hair.

The user can start combing his or her hair in order to smooth it with the teeth 32 of the comb, without pressing the walls of the bottle. The user can then re-apply the comb, as shown in FIG. 3, by positioning one group 37 of teeth, for example the group at the distal end of the comb, on a particular part of the head.

The device can then be moved from the roots of the hair to its tips while pressure is simultaneously applied to the walls of the bottle to make the product exit through the openings 36 between the teeth 32 of the same group of teeth, thereby applying the product to the strands of hair lying between the end teeth of one group of teeth.

In this example, the user simultaneously creates three strands. The process can be repeated by moving the comb to another position in order to apply the product to other strands. In this operation, the user can use a strand that has already been treated as a guide. This makes it possible, for example, to treat the left or the right side in the same way as the other side.

Figure 5:
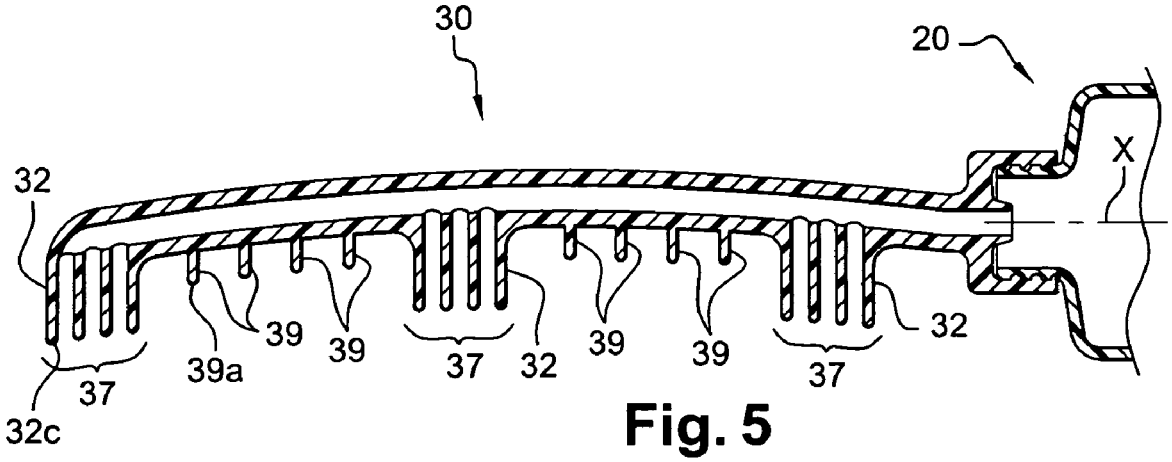

In an alternative embodiment shown in FIG. 5, the comb has projections 39 between two consecutive groups 37 of teeth. The projections can have, for example, the same tooth shape as the teeth 32 but are smaller, with the tips 39*a* being recessed relative to the ends 32*c* of the teeth 32. Preferably, where such projections are provided, the only function of the projections or teeth 39 is to comb the hair, and no openings are provided to supply these teeth 39 with the product, such that the comb can apply product only to strands of hair that are spaced sufficiently apart and in the locations desired. The distance between two adjacent teeth 39 can be identical to the distance between two adjacent teeth 32, or it can be different. For example, the teeth 39 can have a larger spacing between them than teeth 32, as in the example shown in FIG. 5.

Here again, with the FIG. 5 arrangement, the user can readily identify the parts of the comb which enable the product to be applied and can thus easily position the comb on his or her hair in order to dye or bleach the desired strands.

It will be understood that the invention is not limited to the examples described hereabove as a number of variations could also be used. By way of example, the teeth can have shapes other than those shown and in particular they can have projections intended to give an improved grip on the hair. Also, the spacing between the teeth in the same group can be constant, but it is within the scope of the present invention for the spacing to vary along the length of the support.

Throughout the description and the claims, expressions such as having, including, comprising, having one, including one, or comprising one, should be understood to mean "having at least one", unless otherwise stated. Similarly, expressions such as having two or including two, etc., should be understood to mean at least two, unless otherwise stated.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A device for applying a fluid product to hair comprising:

a product reservoir;

a comb, wherein said comb includes at least two groups of teeth each comprising at least two teeth, and wherein a first distance separating two adjacent groups of teeth is greater than a second distance between two teeth respectively located at opposite ends of one of the at least two groups of teeth, and further wherein each group of teeth is supplied with product from at least one product exit opening communicating with an interior of the product reservoir; and wherein a space between the at least two groups of teeth is substantially free of teeth or includes projections having an average length which is less than an average length of the teeth in the two groups of teeth, said comb comprising a first end and a second end, and from said first end toward said second end:

a first group of teeth including, a first tooth, and a second tooth, located at an opposite end of said first group from said first tooth of said first group, said opposite end of said first group being closer to said second end of said comb than said first tooth of said first group; and a second group of teeth including, a first tooth, and a second tooth, located at an opposite end of said second group from said first tooth of said second group, said opposite end of said second group being closer to said second end of said comb than said first tooth of said second group, wherein said second distance is a distance between said first tooth of said first group and said second tooth of said first group, and said first distance is a distance between said second tooth of said first group and said first tooth of said second group.

2. A device according to claim 1, wherein the at least one product exit opening is arranged between two adjacent teeth in a group.

3. A device according to claim 2, wherein the at least one product exit opening is positioned at the base of a tooth.

4. A device according to claim 3, wherein the teeth of the at least two groups have ends lying substantially on an outwardly concave line.

5. A device according to claim 4, wherein the product reservoir is disposed inside a container, and wherein the comb is removably fastened to the container.

6. A device according to claim 5, wherein the comb is removably fastened to the container by being screwed on to the container.

7. A device according to claim 6, wherein the container has a longitudinal axis that is parallel to a plane containing the teeth.

8. A device according to claim 7, wherein the container forms a means by which the comb can be gripped.

9. A device according to claim 8, wherein the container has resiliently deformable walls.

10. A device according to claim 9, wherein the container contains a cosmetic product.

11. A device according to claim 10, wherein the product is a hair product.

12. A device according to claim 11, wherein the hair product includes a dye product.

13. A device according to claim 11, wherein the hair product includes a hair lightening product.

14. A device according to claim 1, wherein the at least one product exit opening is positioned at the base of a tooth.

15. A device according to claim 1, wherein the teeth of the at least two groups have ends lying substantially on an outwardly concave line.

16. A device according to claim 1, wherein the product reservoir is disposed inside a container, and wherein the comb is removably fastened to the container.

17. A device according to claim 1, wherein the product reservoir is disposed inside a container, and wherein the container has a longitudinal axis that is parallel to a plane containing the teeth.

18. A device according to claim 1, wherein the product reservoir is disposed inside a container, and wherein the container forms a means by which the comb can be gripped.

19. A device according to claim 1, wherein the product reservoir is disposed inside a container, and wherein the container has resiliently deformable walls.

20. A device according to claim 1, wherein the product reservoir is disposed inside a container, and wherein the container contains a cosmetic product.

21. A device according to claim 20, wherein the product is a hair product.

22. A device according to claim 21, wherein the hair product includes a dye product.

23. A device according to claim 21, wherein the hair product includes a hair lightening product.

24. A device according to claim 1, wherein the product reservoir is disposed in a container, and wherein the comb includes a support from which the groups of teeth extend, said support including a channel in communication with the container and the at least one product exit opening.

25. A device according to claim 24, wherein the container includes a longitudinal axis and wherein the support extends in substantially the same direction as the longitudinal axis of the container.

26. A device according to claim 24, wherein the product exits said container in substantially the same direction as the flow of product through said channel.

27. A device according to claim 24, wherein the container is disposed to one side of the comb with respect to a direction which said support extends.

28. A device according to claim 24, wherein the container is disposed to one side of said comb with respect to a direction which the first distance between two groups of teeth extends.

29. A device according to claim 1, wherein a plurality of product exit openings are associated with each of the two groups of teeth.

30. A device as recited in claim 1, wherein all of the teeth of the comb extend in substantially the same plane.

31. A device according to claim 1, wherein the first distance is greater than a distance in each group of teeth between teeth respectively at each end of the group.

32. A device according to claim 1, wherein said first distance is a distance between two consecutive teeth of substantially equal height belonging respectively to said two adjacent groups.

33. A device according to claim 32, wherein said space between said at least two groups of teeth is free of any openings communicating with said interior of the product reservoir.

34. A device according to claim 32, wherein the at least one product exit opening is located in substantially the same plane as the plane in which all of the teeth of the comb substantially extend.

35. A device according to claim 32, wherein the at least one product exit opening abuts a base of a tooth.

36. A device according to claim 32, wherein the at least one product exit opening abuts bases of adjacent teeth in at least one of the at least two groups of teeth.

37. A device according to claim 32, wherein a plurality of product exit openings are associated with each of the at least two groups of teeth, and wherein the plurality of product exit openings are located in substantially the same plane as the plane in which all of the teeth of the comb substantially extend.

38. A device according to claim 1, wherein a space over said first distance between the at least two groups of teeth is substantially free of teeth.

39. A device according to claim 1, wherein a space over said first distance between the at least two groups of teeth includes projections having an average length which is less than half of an average length of the teeth in the two groups of teeth.

40. A device according to claim 1, wherein each group of teeth includes one product exit opening between each tooth and an adjacent tooth.

41. A device according to claim 1, wherein said first distance is determined based on said hair to which said fluid product is to be applied.

42. A device for applying a fluid product comprising:

a container containing a product reservoir;

a comb, wherein said comb includes at least two groups of teeth each comprising at least two teeth, and wherein a first distance separating two adjacent groups of teeth is greater than a second distance in each group of teeth between two teeth respectively located at opposite ends of each group of teeth, and further wherein the at least two groups of teeth are each supplied with product from at least one product exit opening communicating with an interior of the container;

wherein a space between the at least two groups of teeth is substantially free of teeth or includes projections having an average length which is less than an average length of the teeth in the two groups of teeth; and wherein the container is disposed to one side of the comb with respect to a direction which the first distance between the at least two groups of teeth extend, said comb comprising a first end and a second end, and from said first end toward said second end:

a first group of teeth including, a first tooth, and a second tooth, located at an opposite end of said first group from said first tooth of said first group, said opposite end of said first group being closer to said second end of said comb than said first tooth of said first group; and a second group of teeth including, a first tooth, and a second tooth, located at an opposite end of said second group from said first tooth of said second group, said opposite end of said second group being closer to said second end of said comb than said first tooth of said second group, wherein said second distance is a distance between said first tooth of said first group and said second tooth of said first group, and said first distance is a distance between said second tooth of said first group and said first tooth of said second group.

43. A device according to claim 42, wherein the comb includes a support from which the two groups of teeth extend, said support including a channel in communication with the container and the at least one product exit opening.

44. A device according to claim 43, wherein the container includes a longitudinal axis and wherein the support extends in substantially the same direction as the longitudinal axis of the container.

45. A device according to claim 43, wherein the product exits said container in substantially the same direction as the flow of product through said channel.

46. A device according to claim 43, wherein a plurality of product exit openings are associated with each of the two groups of teeth.

47. A device according to claim 43, wherein the container includes a longitudinal axis, and wherein the longitudinal axis of the container extends at a non-perpendicular angle with respect to said support.

48. A device according to claim 43, wherein the container includes a longitudinal axis, and wherein the longitudinal axis of the container is substantially parallel to a direction which said support extends.

49. A device according to claim 43, wherein the container is removably fastened to said support.

50. A device according to claim 42, wherein a plurality of product exit openings are associated with each of the two groups of teeth.

51. A device according to claim 42, wherein the container is removably fastened to said comb.

52. A device according to claim 42, wherein the container has a longitudinal axis that is parallel to a plane containing the teeth.

53. A device according to claim 42, wherein the container contains a cosmetic product.

54. A device according to claim 53, wherein the cosmetic product is a hair product.

55. A device according to claim 42, wherein the at least one product exit opening is disposed between adjacent teeth in each of the two groups of teeth.

56. A device according to claim 42, wherein all of the teeth of the comb extend in substantially the same plane.

57. A device for applying a fluid product comprising:

a container containing a product reservoir;

a comb, wherein said comb includes at least two groups of teeth each comprising at least two teeth, and wherein a first distance separating two adjacent groups of teeth is greater than a second distance in each group of teeth between two teeth respectively located at opposite ends of each group of teeth, and further wherein the at least two groups of teeth are each supplied with product from at least one product exit opening communicating with an interior of the container;

wherein a space between the at least two groups of teeth is substantially free of teeth or includes projections having an average length which is less than an average length of the teeth in the two groups of teeth;

wherein the container includes a longitudinal axis, and wherein the comb includes a support from which the teeth of the at least two groups of teeth extend, and wherein the longitudinal axis of the container extends at a non-perpendicular angle with respect to said support; and wherein the at least two groups of teeth each comprise at least four teeth.

58. A device according to claim 57, wherein the longitudinal axis of the container is substantially parallel to said support.

59. A device according to claim 57, wherein a plurality of product exit openings are associated with each of the two groups of teeth.

60. A device according to claim 59, wherein the plurality of product exit openings are disposed between adjacent teeth of the two groups of teeth.

61. A device for applying a fluid product comprising:

a container containing a product reservoir;

a comb, wherein said comb includes at least two groups of teeth each comprising at least two teeth, and wherein a first distance separating two adjacent groups of teeth is greater than a second distance between in each group of teeth between two teeth respectively located at opposite ends of each group of teeth, and further wherein the at least two groups of teeth are each supplied with product from at least one product exit opening communicating with an interior of the container;

wherein a space between the at least two groups of teeth is substantially free of teeth or includes projections having an average length which is less than an average length of the teeth in the two groups of teeth;

wherein the container includes a longitudinal axis, and wherein the longitudinal axis extends at a non-perpendicular angle with respect to a direction which said first distance extends; and wherein the at least two groups of teeth each comprise at least four teeth.

62. A device according to claim 61, wherein the longitudinal axis extends in substantially the same direction as the direction said first distance extends.

63. A device according to claim 61, wherein spaces between the at least two groups of teeth are devoid of product exit openings.

* * * * *